US006000646A

United States Patent [19]

Ranne et al.

[11] Patent Number: 6,000,646

[45] Date of Patent: Dec. 14, 1999

[54] DOUBLE BARREL MEDIA MILL FOR GRINDING AND DISPERSING PARTICULATE MATTER AND PIGMENT FOR PAINT, COATINGS, INK AND OTHER FLUID PIGMENT VEHICLES

[76] Inventors: Bethyl H. Ranne; Bobby C. Ranne, both of P.O. Box 482, Yantis, Tex. 75497; Bill H. Ranne, 36 Leisure La., Jackson, Tenn. 38305

[21] Appl. No.: 09/039,716

[22] Filed: Mar. 16, 1998

[51] Int. Cl.[6] ..... B02C 17/16

[52] U.S. Cl. ..... 241/46.17; 241/172; 241/179

[58] Field of Search ..... 241/46.11, 46.17, 241/172, 173, 179

[56] References Cited

U.S. PATENT DOCUMENTS

| | | | |
|---|---|---|---|
| 3,008,657 | 11/1961 | Szegvari | 241/170 |
| 3,539,117 | 11/1970 | Sjogren | 241/172 |
| 3,848,816 | 11/1974 | Morley | 241/74 |
| 4,496,106 | 1/1985 | Gross | 241/46.17 |
| 4,673,134 | 6/1987 | Barthelmess | 241/57 |
| 4,998,678 | 3/1991 | Durr | 241/171 |
| 5,114,083 | 5/1992 | Ikebuchi et al. | 241/153 |

OTHER PUBLICATIONS

Form No. 397–5M, 1997, Union Process, HQ Series High Speed Circulation Attritor, Small Media Milling System. No Date.

BM02A.DOC, Supplementary Data Sheet, *Pilot & Production Sized 'Maxi' Motormills*, Eiger Machinery Inc. No Date.

Draiswrke, Inc. "*Innovative Concepts With Proven Design*" Innovative Technology For All Your Processing Needs. No Date.

Schold Machine Corporation, New From Schold® Horizontal Media Mills. No Date.

FC 67405 en 9703 2000 DF Buhlere, High–Capacity Beed Mill, 9000 SC Topas, FKX. No Date.

2.5M 7/85 Com/Tech (3597) Schold Machine Corp., Model HSSM High Speed Shot Mill. No Date.

9708–LT–7.5M EMCO U.S.A. (Epworth Morehouse–Cowles, Over 75 Years experience in mixing, dissolving and dispersing Guarantees Performance. No Date.

5/96/D15000 Draiswerke, Inc., The "original" Drais High–Performance Media Mills. No Date.

FC 67406 en 9611 2000 DF Buhler, K60 Conical Bead Mill. No Date.

DD 48002 B.EN 6 Superflow/3000/11.96/Th/Printed in Germany, Drais Mannheim DCP–Superflow®. No Date.

©1997 Netzsch Incorporated, Netzsch Galaxy, Module 250–10. No Date.

©1997, Union Process Inc., Union Process "Deltamill® Small Media Milling System". No Date.

Eiger Production, Quality Bead Mills quality Products, Particle Size Reduction and Dispersion of Liquids and Pastes Products. No Date.

PM–S2 10/97 Supermill, Premier Mill, Milling technology at its smartest and most productive. No Date.

PM–S 8/97 Supermill, Premier Mill, Horizontal Media Mills designed for performance and versatility. No Date.

Eiger 'Maxi' Mill, Self–Contained Laboratory Horizontal Bead Mill, 0.5, 1 and 2 Liter models. No Date.

*Primary Examiner*—John M. Husar

*Attorney, Agent, or Firm*—Waddey & Patterson; Mark J. Patterson

[57] ABSTRACT

A double barrel chamber for a media mill where the media mill is used to grind and disperse pigments for paint, coating, ink products, and other pigment-vehicle fluids, as well as grinding and dispersing other particulate matter. Centered in each barrel is a rotatable shaft. On each shaft are a number of horizontally spaced discs. The shafts are parallel and arranged such that the edges of the discs overlap to cause major impacting and mixing in the central portion of the chamber when the shafts are rotated in a common direction. Also disclosed is a coiled cooling water jacket system for cooling a chamber. The system allows 100%, or near 100%, recovery of cleaning solvent, limits potential damage to a pumping system and allows slurry feeding flexibility. A special bearing seal section is disclosed which allows use of a diaphragm pump. The pump in conjunction with the spinning discs force the pigment slurry up from the bottom of the chamber and out through a specially designed discharge screen which is also disclosed. A bump feature on each disc is disclosed. The bump feature increases pumping and impact of media in the media mill.

17 Claims, 5 Drawing Sheets

DOUBLE BARREL MEDIA MILL FOR GRINDING AND DISPERSING PARTICULATE MATTER AND PIGMENT FOR PAINT, COATINGS, INK AND OTHER FLUID PIGMENT VEHICLES

APPLICATION FOR UNITED STATES LETTERS PATENT

Be it known that we, Bethyl H. Ranne, a citizen of United States, residing at P.O. Box 482, Yantis, Tex. 75497; Bobby C. Ranne, a citizen of the United States, residing at P.O. Box 482, Yantis, Tex. 75497; Bill H. Ranne, a citizen of United States, residing at 36 Leisure Lane, Jackson, Tenn. 38305; have invented a new and useful "Double Barrel Media Mill for Grinding and Dispersing Particulate Matter and Pigment for Paint, Coatings, Ink and Other Fluid Pigment Vehicles."

BACKGROUND OF THE INVENTION

For more than a century (1825 to 1950) "Ball Mills" were used to grind and disperse pigment for paint, coatings, ink, and other pigment-vehicle fluids. Ball mills use steel, stone, or ceramic balls. Some disadvantages to ball mills are that they require a long dispersion time, they are hard to clean, and they take up large amounts of space. Not only are ball mills generally much larger than subsequent generation of grinding mills, but ball mills are generally supported in a horizontal configuration because the vertical configuration requires more floor space below the structure than the horizontal configuration. A more "modern" concern is an environmental one; ball mills create heavy noise pollution problems. This is primarily due to the "balls" banging about the mill, and the required heavy rotating machinery.

In the later 1950's, the first "Media Mills" were developed. Media mills, also known as "sand mills" or "sand grinders", use very small diameter grinding media, on the order of 20–40 mesh Ottawa type sand. This takes advantage of the large surface area per unit weight which cannot be used effectively in ball mills. The basic media mill structure consists of a vertical cylinder with a rotating shaft through its center, two or more flat impellers on a shaft, and a pump at the bottom which forces a premixed pigment-vehicle fluid paste through the milling zone and out through a discharge screen to retain the sand. Fluid is discharged into drums or pumped on for additional processing.

A specific example is a Moorehouse-Cowles mill. The 12–50 model uses a twelve inch diameter cylinder with ten inch diameter discs on a rotatable shaft and a 50 HP motor. Moorehous-Cowles manufacturers media mills with barrel diameters approximately 6, 8, 10 and 12 inches; Chicago Boiler Corp. (CBC) has similar sizes available. As the size of the barrel increases in diameter, the amount of output of dispersed pigment increases. However, the larger the barrel, the more horse power is required to drive the mill to produce a specific quantity of dispersed pigment. For instance, a six inch mill from Chicago Boiler may be powered by 15 HP electric motor whereas a twelve inch mill will need a 40–50 HP motor.

It is believed that in a single cylinder mill, grinding is mostly accomplished through impact of the mixture on the cylinder walls and shearing forces produced by velocity differences between layers of fluid. Dispersion is mostly the result of stacked vertices within the cylinder and the shearing forces. Rotating the impellers causes sand-paste mixture near their surfaces to rotate faster than the layers farther away. The layers closest to the top-side of an impeller are pulled from the shaft region and pushed toward the cylinder wall by the centrifugal force produced when the shaft is rotated. These layers are then forced up the side of the cylinder wall. Simultaneously, layers closest to the bottom-side of an impeller are also pulled from the shaft region and pushed towards the cylinder walls. In contrast to the layers closest to the top-side of an impeller, the layers closest to the bottom-side of an impeller will be forced down the walls of the cylinder. Thus, in an area between the top-side of an impeller and the bottom-side of an adjacent impeller, the fluid layers collide and are forced back toward the shaft region. This results in counter-clockwise rolled layers, i.e. a counter-clockwise vortex near the top-side of an impeller and a clockwise vortex near the bottom-side of an impeller.

The difference in velocity of adjacent layers produces the required shearing action for further grinding and dispersion. Pigment aggregates between two sand particles in adjacent layers are subjected to a compressive force in one direction, which resolves into a shearing stress at a different angle. The maximum shear stress at the impeller surface is, roughly, a function of the pigment cross sectional area, given a constant media (sand) cross-section. Allowing that the shear stress in the overall mixture is approximately (½ psi), an approximation for the maximum shear stress at the impeller's surface reduces to: (½ psi) times the ratio of sand cross-sectional area to pigment cross sectional area.

The consistency of the sand-paste must be carefully adjusted. The fluid-paste must be viscous enough to be moved by impellers, but excessive viscosity reduces sand movement and milling action. Too low a consistency results in poor circulation, sand skidding, and wear on impellers. A machine can be jacketed for control of temperature during grinding. The machine may be cleaned by running solvent through it. However, sand costs are relatively cheap, so the sand may be discarded to avoid cleaning a hard to clean color out of media. Using sufficient premixers to ensure continuous flow of paste to the mill, the sand grinder can be used for automatic continuous operation.

While the standard single cylinder has been a significant improvement over standard ball mills and has been adequate for most purposes, it does have its drawbacks. Milling time can be long, especially for larger diameter particulates. Some matter, for instance carbon blacks, can only be milled using steel ball mills. Steel ball mills are not an acceptable milling process in today's environment due to the disadvantages previously mentioned. Additionally, standard gear pumps used in sand mills are subject to severe wear if media gets into the pumping gear and pump system.

It would be useful to develop an improved dispersing chamber with improved grinding efficiency over that of standard media mills. A chamber that would reduce the cycle time of hard to disperse/grind pigment, or grind particulates not heretofore possible to grind with a media mill, would be a significant improvement over existing dispersing chambers.

SUMMARY OF THE INVENTION

This invention relates generally to media mills, also known as "sand mills" or "sand grinders", for dispersion (or grinding) of pigment for coatings such as paint, ink and other pigment-vehicle fluids. Such mills are also used for grinding and dispersing particulate matter, other than pigment, in fluid-like products. Standard media mills employ a single cylinder milling chamber with a central shaft on which discs, or impellers, or pumping plates, are situated for grinding, and pumping through the cylinder, a pigment slurry.

One embodiment of this invention employs a "double barrel" grinding chamber having a horizontal cross-section resembling that of a "figure 8." The diameters of two circular chambers are overlapped to form the "figure 8" chamber. The "figure 8" chamber thus has two semi-circular halves. Centered within each semi-circular half is a shaft on which impellers, generally discs, are horizontally spaced for grinding and pumping a pigment slurry through the chamber. Each shaft is rotated clockwise or counter clockwise, the same direction as the other shaft. The shafts may be turned by separate independent motors, by separate motors in synchronization, or by one common motor. The number and size of the discs should be such that the discs sufficiently overlap to cause major impact and mixing in the disc overlap portion of the chamber.

In the disc overlap region, the velocity vector of the disc on one shaft is the opposite of the velocity vector of the other disc on the other parallel shaft. Thus, the fluid-paste, or pigment slurry, near the disc on one shaft is moving opposite the fluid-paste near disc on the other shaft. The resultant force impact is greater than the force of impact due to the fluid-paste impacting a stationary wall, as in single-cylinder mill. Additionally, elimination of the "central wall," the wall between two sections, is believed to have eliminated the vortices between discs of the shaft in that region, thereby reclaiming, or at least redirecting that, previously, "lost" energy.

A double barrel, or two portioned, chamber was tested. During testing, a chamber having two portions was formed by joining two twelve inch diameter cylinders of a type similar to a 50 HP Moorehouse-Cowles mill. The diameters of the cylinders were overlapped four inches; resulting in a length of twenty inches across the longest direction of the "figure 8" i.e. the length from one end of a semi-circle to the opposite end of the other semi-circle. The semi-circular widths were still twelve inches. Six discs, from a twelve disc single barrel model, were placed on a rotatable shaft in each semi-circle portion. The mill was run as a single50 HP mill, that is, at 900 r.p.m., same pump rate and with glass media. Thirty minutes after such operation, the glass media was 50% pulverized. This is unacceptable for pigment grinding and dispersion because the media itself is ground down and thus mixes with the pigment instead of grinding the pigment down and then being separated from the now pigmented fluid. If ones desires to use glass media, the shaft r.p.m. and pump rate parameters can be altered along with the grinding time.

Next, three millimeter steel shot media was used with the aforementioned single barrel parameters. This proved effective to grind down carbon blacks. Heretofore, grinding of carbon blacks could only be accomplished on steel ball mills. However, during the media mill grinding process, the transfer of energy was so great that the cooling of the mill had to be improved. Use of a coil cooling jacket proved effective over the use of a conventional water jacket system. Alternatively, a conventional, or normal, water jacket used in conjunction with a coiled cooling water jacket could be used. In one such arrangement the coiled cooling water jacket is immersed in the conventional water jacket, or phrased differently, place the conventional water jacket "over" the coiled cooling water jacket. The coiled cooling system can be used to ensure no "hot spots" form which might fatigue a chamber or dispersion components.

As compared to a single cylinder mill, the double barrel mill was more efficient. While a six inch diameter single requires a 15 HP motor and a twelve inch diameter single requires a 40 HP to 50 HP motor; an eight inch double barrel yields the capacity of a 50 HP single yet requires only a 30 HP motor. A 50 HP 12/20 double barrel yields three to five times the output of a standard 50 HP single barrel.

An embodiment of the invention includes an impeller, or a disc, with a "bump feature" running in the radial direction or ray. The "bump feature" increases the pumping and the impact force of the grinding media in the mill. While a single bump feature may be used, it is recommended to use at least two bump features where the bump features are spaced symmetrically about the disc. Such symmetric spacing helps maintain the disc balance. Further, a bump feature may be so thin as to resemble a blade. The feature may be run continuously or intermittently along a radial direction. If intermittent, the spacing should be staggered between adjacent rays.

An embodiment of the invention uses a single electric motor to drive both shafts.

An embodiment of the invention uses a special seal section design to create a seal which is pressure resistant, heat resistant and solvent resistant. This seal section is constructed of teflon and carbon fiber materials with a specially designed metal enclosure. This seal allows use of a diaphragm pump. In a diaphragm pump embodiment, the pigment slurry is fed through the feed end of the chamber, generally the bottom, using the diaphragm pump. The slurry encounters the lower discs which are mounted on twin drive shafts in turning in the same direction, and the pigment slurry is forced upwards by the pump, as well as the pumping and spinning action of the rotating overlapping discs. While there is some dispersion on the sides of the inner wall of the cylinders, the main and strongest dispersion takes place in the area where the spinning discs overlap.

Another embodiment incorporates a specially designed discharge screen. As the slurry reaches the top of the chamber it is automatically discharged through the screen. The screen is designed for ease of maintenance and replacement.

The lower feed system and special design discharge screen reduce the overall costs by reducing the required time to clean up and the amount of solvent used. Grind cycle time has been reduced and ease of achieving full color development has been increased.

DESCRIPTION OF THE PREFERRED EMBODIMENTS

Figure 1:
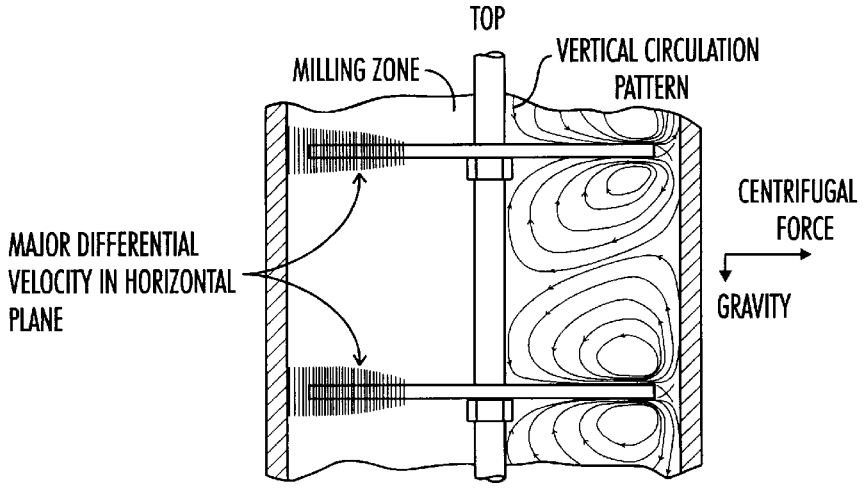
FIG. 1 (PRIOR ART)
FIG. 1 is a circulation pattern in a single cylinder media mill.
Figure 2A:
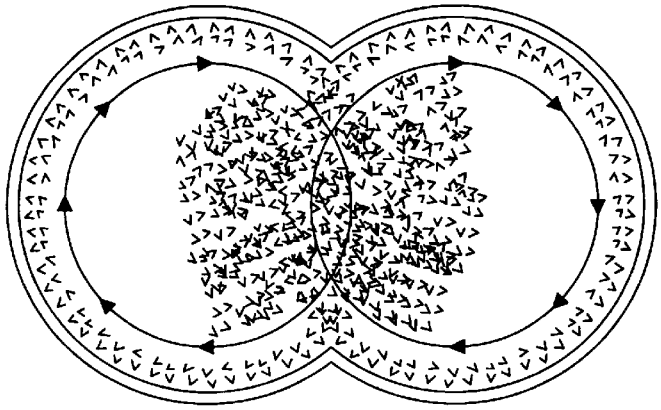
FIG. 2*a* is a double barrel cross section in circulation pattern.
Figure 2B:
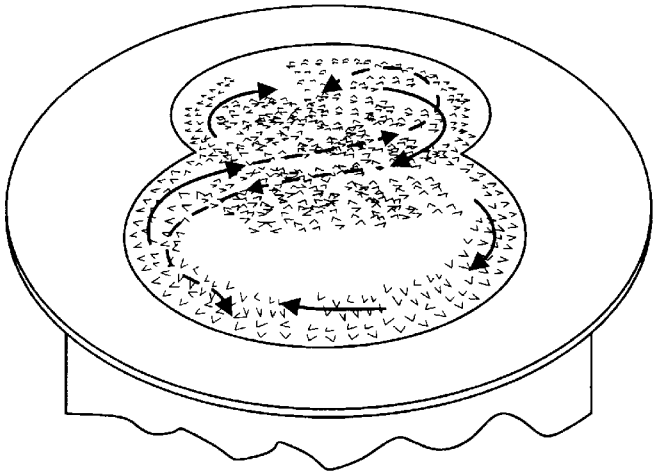
FIG. 2*b* is a double barrel circulation pattern.
Figure 3:
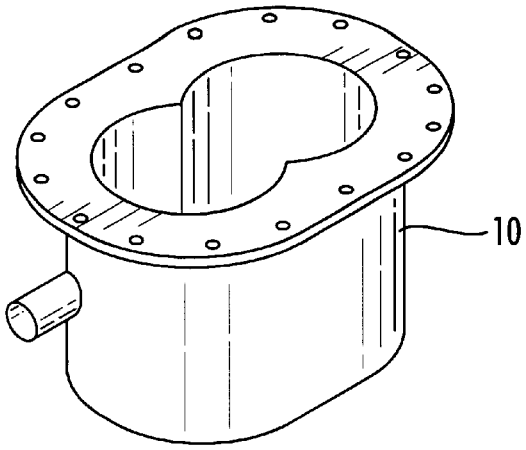
FIG. 3 is a perspective view of double barrel chamber.
Figure 4A:
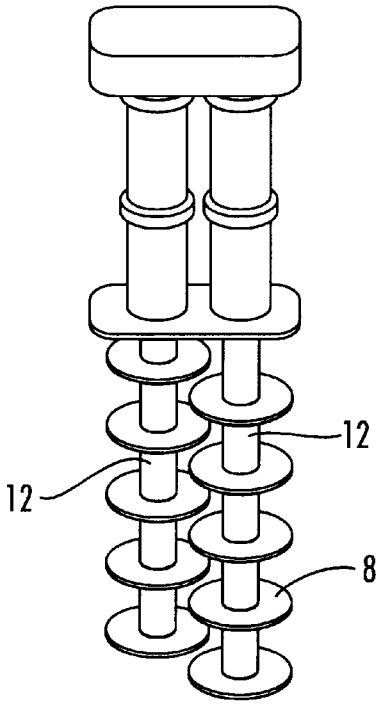
FIG. 4*a* is a view showing parallel shafts with discs overlapped.
Figure 4B:
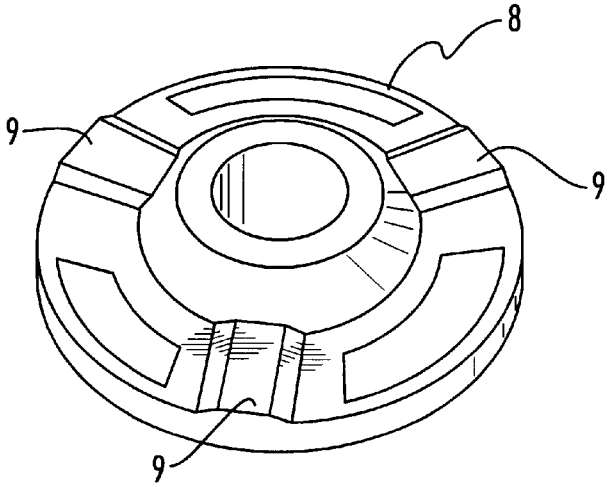
FIG. 4*b* is a disc with bump feature.

Applicant's invention will be best understood when considered in light of the following description of the preferred embodiment of the invention, as illustrated in the attached drawings wherein like reference numerals and characters refer to like parts.

Figure 6:
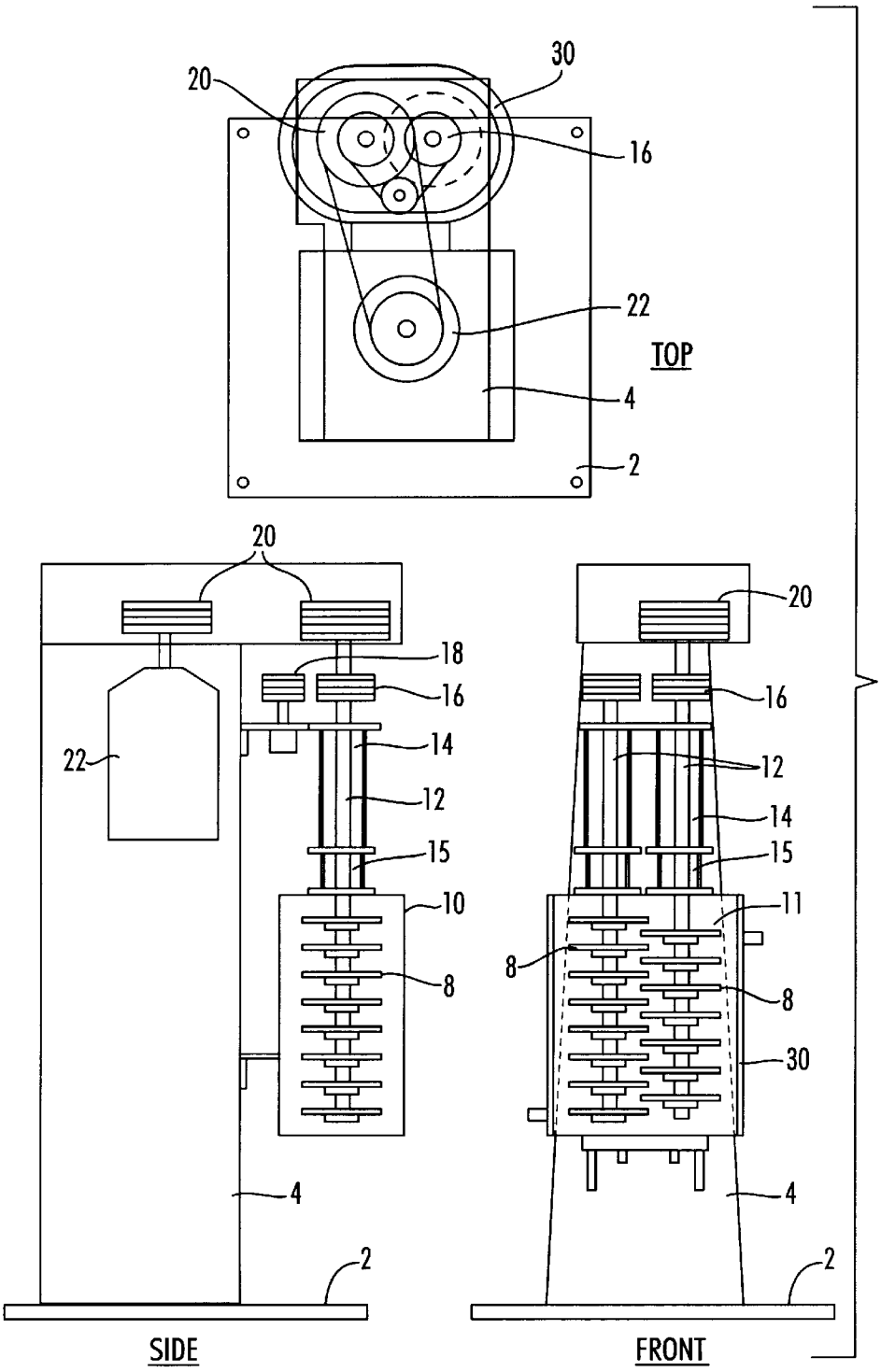
FIG. 6 is a media mill employing a double barrel design.
Figure 7:
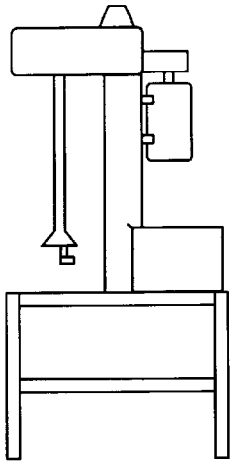
FIG. 7 (PRIOR ART)
FIG. 7 is a prior art media mill.

FIGS. 7 through 10 are of prior art media mills using a single cylinder chamber design. FIG. 6 depicts a preferred embodiment of the invention. In the preferred embodiment of the invention a media mill is constructed comprising a base (2) and frame (4) structure for supporting and housing the various elements of the media mill. A double barrel chamber (10) is used for milling the media, that is, grinding and dispersing a pigment in a pigment-vehicle fluid to obtain a uniform color, or coating, mixture. The double barrel is supported by the frame. The double barrel (10) has a cross section, when viewed looking down through the barrel, resembling a "figure 8." In each semi-circle of the double barrel (10), i.e. each loop of the "8", a rotatable shaft (12) is length-wise aligned and centered. The shafts (12) are housed and rotatably supported in a bearing section (14). The shafts are connected to a common motor (22) through connector pulleys and drives (16) and an idler pulley (18) to a main drive (20), which in turn is driven by the common motor (22). Thus both shafts (12) will be rotated in a common direction by the common motor (22). The common motor and pulleys are supported by the frame as is the bearing section. A bearing seal section (15) is located between the chamber section and the bearing section. In the preferred embodiment, the bearing seal section is made of teflon and carbon fiber materials and a metal enclosure. It forms a pressure resistant, heat resistant, and solvent resistant seal.

Within the double barrel, mounted on the shafts, are discs (8). The discs (8) are horizontally spaced along the shafts (12) with substantially the same number of discs on each shaft. The discs (8) are, preferentially, made of hardened steel and contain bump features. Three bump features (9) are symmetrically spaced about the discs (8), where the bump runs in a radial direction, or a ray from the central portion to the outer edge of the disc. The bump features allow for increased pumping and grinding of the media. The total number of discs, and size of discs should be such that the discs sufficiently overlap to cause major impacting and mixing of the pigment slurry in the central portion of the double barrel chamber when the shafts are rotating in a common direction. The diaphragm pump allows a pigment slurry to be fed from the bottom of the double barrel, where the slurry encounters the spinning discs. The spinning discs, along with the diaphragm pump, force the slurry up through the chamber to discharge through a specially designed discharge screen (11) as the slurry reaches the top of the double barrel chamber. The screen is designed for ease of maintenance and replacement. It is located near the top of the double barrel chamber. The system allows 100%, or near 100%, recovery of a cleaning solvent, limits potential damage to the pumping system (by limiting possible media incursion into the pumping gears), and allows more flexibility for feeding the slurry material.

Figure 5:
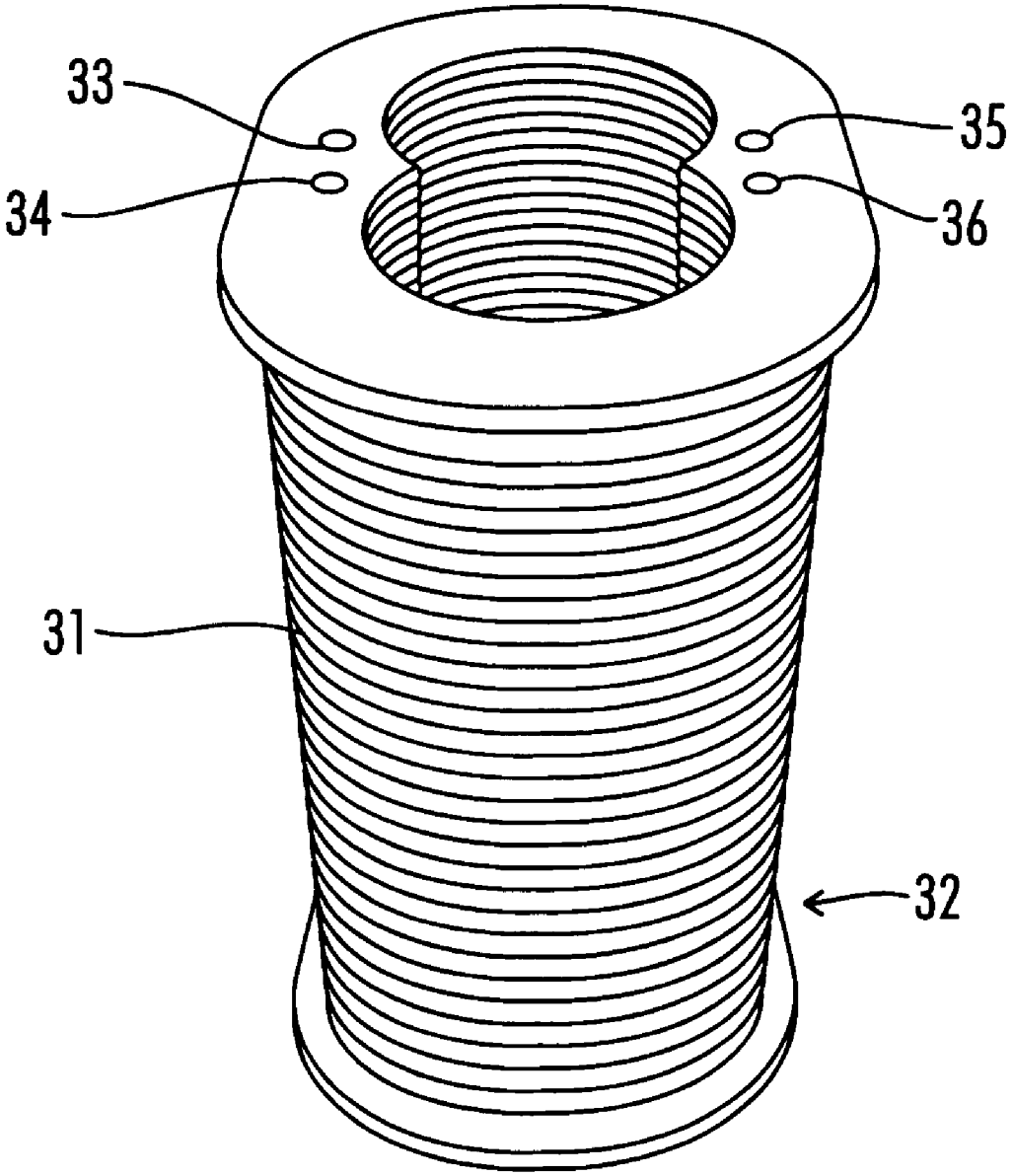
FIG. 5 is a coiled cooling water jacket immersed in normal water jacket.

The preferred embodiment also incorporates an improved cooling system. The cooling jacket (30) is placed around the double barrel chamber. FIG. 5 depicts the cooling system in more detail. The cooling system includes a coiled cooling water jacket immersed in a conventional, or normal, water jacket. Approximately 90 feet of copper coil (31) is coiled about the double barrel to ensure that no hot spots will form. Other fluids, such as oil, may be run through the coil for temperature control. The conventional water jacket has approximately 1¼ inch of water surrounding the coils (32). The water jacket/vessel has orifices for: a control well (33), discharge of water from the coil system (34), discharge of water from the outer vessel (35), a temperature gauge, electric water value heat transfer or alternate control well (36).

Thus, although there have been described particular embodiments of the present invention of a new and useful Double Barrel Media Mill for Grinding and Dispersing Particulate Matter and Pigment for Paint, Coatings, Ink and Other Fluid Pigment Vehicles, it is not intended that such references be construed as limitations upon the scope of this invention except as set forth in the following claims.

Figure 8:
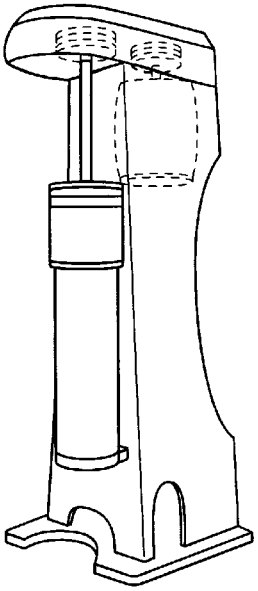
FIG. 8 (PRIOR ART)
FIG. 8 is a prior art media mill.
Figure 9:
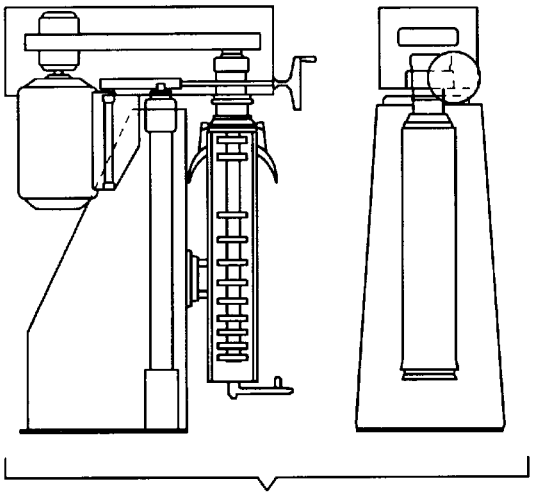
FIG. 9 (PRIOR ART)
FIG. 9 is a prior art media mill.
Figure 10:
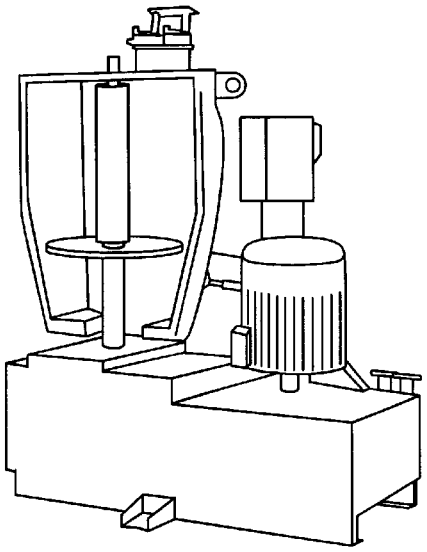
FIG. 10 (PRIOR ART)
FIG. 10 is a prior art media mill.

What is claimed is:

1. A media mill for grinding and dispersing pigments and other particulate matter in a pigment slurry comprising:

a chamber having a first portion and a second portion in fluid communication with said first portion;

a first fluid propagating implement adapted to be driven and operably positioned to propagate a fluid in said first portion toward a fluid in said second portion;

a second fluid propagating implement adapted to be driven and operably positioned to propagate a fluid in said second portion toward a fluid in said first portion;

said first portion has a semi-circular cross-section; and said second portion has a semi-circular cross-section, wherein said first and second portions are joined together to form a double barrel chamber having a figure 8 shape.

2. The media mill as claimed in claim 1, wherein said first propagating implement includes a rotatable shaft positioned in said first portion and aligned with an axis normal to said cross-section of said first portion and adapted to be connected to a drive; and said second propagating implement includes a rotatable shaft positioned in said second portion and aligned with an axis normal to said cross-section of said second portion and adapted to be connected to a drive.

3. The media mill as claimed in claim 2, wherein said first fluid propagating implement includes a plurality of discs distributed along said first rotatable shaft; and said second propagating implement includes a plurality of discs distributed along said second rotatable shaft.

4. The media mill as claimed in claim 3, wherein said plurality of discs are designed and spaced such that discs on said first shaft partially overlap discs on said second shaft.

5. The media mill of claim 2 further comprising a cooling system having a coiled cooling water jacket, wherein said jacket is adapted to be coiled about a multi-chamber for a media mill.

6. The media mill as claimed in claim 5, wherein said coiled jacket is immersed in a conventional water jacket and said conventional water jacket is adapted to be wrapped about a multi-chamber for a media mill.

7. A media mill for grinding and dispersing pigments and other particulate matter in a pigment slurry, said media mill comprising:

a chamber including a first portion having a diameter, a second portion having a diameter and joined to and in fluid communication with said first portion at a central impact zone between the first and second portions, a feed end in fluid communication with said first and second portions, a discharge end in fluid communication with said first and second portions, a first fluid propagating implement adapted to be driven and to propagate fluid from said first portion to said second portion, wherein said first fluid propagating implement is operably connected to said first portion, and a second fluid implement adapted to be driven and to propagate fluid from said second portion to said first portion, wherein said second fluid propagating implement is operably connected to said second portion, a base supporting said chamber;

a drive supported by said base and connected to said fluid propagating implements to drive said fluid propagating implements;

a pigment slurry feeding system supported by said base and in fluid communication with said chamber feed end;

a cooling system adapted to cool said chamber operably connected to said chamber and supported by said base; and wherein the impact zone has a width that is smaller than the diameters of said first and second portions.

8. The media mill as claimed in claim 7, wherein:

said first fluid propagating implement includes a first rotatable shaft positioned in said first portion; and said second fluid propagating implement includes a second rotatable shaft positioned in said second portion, wherein said rotatable shafts and are rotatably supported in said portions.

9. The media mill as claimed in claim 8, wherein said fluid propagating implements include a plurality of impellers distributed between, and along, said first and said second rotatable shafts, wherein said impellers overlap in said impact zone.

10. The media mill as claimed in claim 9, wherein, said impeller is a disc including at least one bump feature means for increasing pumping and impacting of a pigment slurry in said chamber.

11. The media mill as claimed in claim 8, wherein:

said cooling system includes a coiled cooling water jacket wrapped about said chamber.

12. The media mill as claimed in claim 11, wherein said cooling system includes a primary water jacket wrapped about said chamber, wherein said coiled jacket is immersed in said primary water jacket.

13. The media mill as claimed in claim 9, wherein:

said support of said rotatable shafts includes a bearing section operably connected to said chamber; and a bearing seal section between and connected to said chamber and said bearing section.

14. The media mill as claimed in claim 13, wherein:

said bearing seal section forms a pressure resistant, heat resistant, and solvent resistant seal allowing use of a diaphragm pump.

15. The media mill as claimed in claim 14, wherein:

said pigment slurry feeding system includes a diaphragm pump connected to said chamber fill end.

16. The media mill as claimed in claim 8, wherein:

said drive includes a common motor connected to said rotatable shafts.

17. A media mill for grinding and dispersing pigments and other particulate matter in a pigment slurry, said media mill comprising:

a chamber including a first portion, a second portion in fluid communication with said first portion at an impact zone, a feed end in fluid communication with said first and second portions, a discharge end in fluid communication with said first and second portions, a first fluid propagating implement adapted to be driven and to propagate fluid from said first portion to said second portion, wherein said first fluid propagating implement is operably connected to said first portion, and a second fluid propagating implement adapted to be driven and to propagate fluid from said second portion to said first portion, wherein said second fluid propagating implement is operably connected to said second portion;

a base supporting said chamber;

a drive supported by said base and connected to said fluid propagating implements to drive said fluid propagating implements;

a pigment slurry feeding system supported by said base and in fluid communication with said chamber feed end;

a cooling system adapted to cool said chamber operably connected to said chamber and supported by said base;

said first fluid propagating implement includes a first rotatable shaft positioned in said first portion; and said second fluid propagating implement includes a second rotatable shaft positioned in said second portion, wherein said rotatable shafts and are rotatably supported in said portions;

said first portion has a semi-circular cross-section; and said second portion has a semi-circular cross-section;

said fluid propagating implements include a plurality of impellers distributed between, and along, said first and said second rotatable shafts, wherein said impellers overlap in said impact zone;

said first rotatable shaft is aligned with an axis normal to said to said first portion cross-section;

said second rotatable shaft is aligned with an axis normal to said to said second portion cross-section;

said support of said rotatable shafts includes a bearing section, operably connected to said chamber, and a bearing seal section between and connected to said chamber and said bearing section, wherein said bearing seal section forms a pressure resistant, heat resistant, and solvent resistant seal allowing use of a diaphragm pump;

said pigment slurry feeding system includes a diaphragm pump connected to said fill end of said chamber;

said discharge end includes a specially designed discharge screen, wherein said screen is designed for ease of maintenance and replacement;

said cooling system for said chamber includes a cooling jacket wrapped about said chamber;

said drive includes a common motor connected to said rotatable shafts, whereby a pigment slurry fed into the pigment slurry feed with the aid of the diaphragm pump encounters rotating blades, rotated by the common motor, which mix, grind and pump the pigment slurry through the chamber to the chamber discharge end to be automatically discharged through the discharge screen.

* * * * *